252-151 AU 166 EX
3/27/84 XR 4,439,338

United States Patent [19]
Tomaiuolo et al.
[11] 4,439,338
[45] Mar. 27, 1984

[54] SOLUTION FOR STRIPPING A LAYER OF TIN OR TIN-LEAD ALLOY FROM A SUBSTRATE BY MEANS OF A SPRAYING OPERATION

[75] Inventors: Francesco Tomaiuolo, Turin; Michele Capano, Rivalta, both of Italy

[73] Assignee: Alfachimici S.p.A., Turin, Italy

[21] Appl. No.: 420,918

[22] Filed: Sep. 21, 1982

[30] Foreign Application Priority Data

Oct. 14, 1981 [IT] Italy ..... 68323 A/81

[51] Int. Cl.[3] ..... C09K 13/00
[52] U.S. Cl. ..... 252/79.1; 156/664; 134/3; 252/149; 252/151
[58] Field of Search ..... 156/664; 252/79.1, 79.3, 252/79.4, 149, 151; 134/3

[56] References Cited

U.S. PATENT DOCUMENTS

| | | | |
|---|---|---|---|
| 2,698,781 | 1/1955 | Meyer | 156/642 |
| 2,956,956 | 10/1960 | Strauss | 252/149 |
| 3,365,401 | 1/1968 | Saubestre et al. | 252/149 |
| 3,677,949 | 7/1972 | Brindisi et al. | 252/79.4 |
| 4,004,956 | 1/1977 | Brindisi, Jr. | 156/666 |
| 4,009,299 | 2/1977 | Flowers et al. | 252/79.1 |
| 4,374,744 | 2/1983 | Kawanabe et al. | 156/664 |
| 4,397,753 | 8/1983 | Czaja | 156/664 |

FOREIGN PATENT DOCUMENTS

| | | |
|---|---|---|
| 2412134 | 10/1974 | Fed. Rep. of Germany . |
| 2102030 | 3/1972 | France . |

*Primary Examiner*—Jerome W. Massie
*Attorney, Agent, or Firm*—Young & Thompson

[57] ABSTRACT

The invention relates to a chemical solution capable of selectively stripping a layer of tin or tin-lead alloy from a substrate, generally of copper, by means of a spraying operation, without requiring the use of any specially designed machine, inasmuch as the solution does not exhibit any particular aggressiveness in respect of the metal materials of which the spraying machines are usually made, and is nevertheless able to selectively strip and maintain in solution the tin or the tin-lead alloy, without etching the copper substrate. The solution comprises mainly an acid of organic nature appertaining to the group including the class of the alkylsulfonic acids having a number of carbon atoms from 1 to 4, such as in particular the methanesulfonic acid. The solution also contains an aromatic nitro-substituted compound including a solubilizing group, which is adapted to oxidize the tin-lead alloy and to facilitate the etching action of the organic acid. A further component of the solution is formed by thiourea or alkyl-substituted or aryl-substituted thioureas, whose function consists in preventing the tin from being deposited again onto the copper substrate.

10 Claims, No Drawings

SOLUTION FOR STRIPPING A LAYER OF TIN OR TIN-LEAD ALLOY FROM A SUBSTRATE BY MEANS OF A SPRAYING OPERATION

BACKGROUND OF THE INVENTION

The present invention relates to a solution for selectively stripping a layer of tin or tin-lead alloy from a substrate, which solution is particularly suitable for a spraying operation.

The necessity of providing a solution capable of selectively stripping a layer of tin or tin-lead alloy from a substrate, generally of copper, by means of a spraying operation, originates from an evolution of the printed circuits manufacturing technique. In the currently used technique the stripping of the alloy from the copper substrate is carried out only in the proximity of the connectors, whilst with the new technique of leveling in hot air it is necessary to carry out a complete stripping of the tin-lead alloy, whose only function is to provide during the etching stage a protective coating, from the entire copper surface. With such technique it would be highly desirable to carry out the stripping of the alloy by way of a spraying operation, inasmuch as the productivity would be a greatly increased and the necessity of manual operations would be reduced.

However, with the baths presently available in commerce, it is not possible to carry out this operation with the normal spraying machines, because these baths are highly corrosive in respect to the metal materials of which the machines are usually made, and therefore to use these baths it is necessary to convert the machines or to design new machines specially conceived for this specific purpose. In fact, the metallic components (recirculation pump, nozzles etc.) of the spraying machines available at present are generally made of titanium, a metal which resists very well to the ammoniacal ambient of the alkaline etchers normally used with such machines, but is quickly and strongly attached by the inorganic acids, such as chromic acid, nitric acid, and particularly fluoboric acid and its derivatives, as well as by other components, such as the peroxide solutions, which are contained in the formulations of the baths presently available in commerce for the stripping of layers of tin and tin-lead alloys.

BRIEF SUMMARY OF THE INVENTION

The object of this invention is to provide a solution capable of selectively stripping the layer of tin or tin-lead alloy from a substrate of copper or of any other metallic or non-metallic material, by means of a spraying operation, by using the normal etching machines whose metallic part is generally made of titanium.

This object is attained according to the invention by using acids of organic nature which appertain to a group having the peculiar characteristic of not being aggressive in respect of titanium, i.e. alkylsulfonic acids having a low number of carbon atoms, and the present invention generally contemplates the use of acids having a number of carbon atoms from 1 to 4. A most suitable acid for practical application has proved to be methanesulfonic acid. These acids have the property of being able to form very soluble salts of tin and lead, and, consequently, to solubilize a large quantity of tin-lead, thus ensuring a good yield.

To selectively strip the tin or the tin-lead alloy from the copper substrate it is necessary to combine the action of these organic acids with that of a mild oxidizing agent which is inert in respect of the base laminate of copper and at the same time is not aggressive in respect of the titanium. This result is obtained by the use of aromatic nitro- and polynitro-derivatives made soluble by the introduction of hydrophilic groups of the type $-SO_3H$, $-COOH$ and their salts.

A third component of the bath is represented by thiourea or its aliphatic or aromatic derivatives having a low molecular weight, whose specific function is to inhibit any redeposition of the tin onto the copper substrate, which redeposition otherwise could take place just during the operation of etching the alloy.

The active components of the solution according to the invention may be present therein in very variable concentrations, depending on the desired rate of attack, on the quantity of tin-lead which it is desirable to maintain in solution, etc. In particular, the organic acid may be present with concentrations ranging from 1 g/l to saturation, but the optimal range is from 30 g/l to 120 g/l. The concentration of the aromatic nitro-derivative containing a solubilizing group may vary from 0.5 g/l to saturation, but the best results are obtained when this concentration is comprised in the range from 20 to 70 g/l. The thiourea derivative may be present in an amount ranging from 0.1 to 50 g/l, preferably from 1 to 10 g/l.

A solution having the composition described hereinabove has a very high attack rate when used by spraying, but a more moderate rate of attack when used by immersion. In its preferred field of application, i.e. by a spraying method, the said solution is capable of uniformly attacking a 10 microns thick tin-lead layer in 60–90 seconds, without the necessity of using any particular rate promoters. The treatment by immersion is less preferable because of its lower rate of attack, but it is applicable as well.

A solution having the formulation according to the present invention is operative within a wide range of temperatures, but the level which is preferable for reasons of operation simplicity is the ambient temperature. Obviously, the rate of attacking the tin or the tin-lead alloy increases with the treatment temperature.

The subject-matter solution is capable of indifferently stripping layers of tin or of binary tin-lead alloys, in which the two metals may be present in whatever ratio.

DETAILED DESCRIPTION OF PREFERRED EMBODIMENTS

In the following there are indicated some examples of compositions according to the present invention:

EXAMPLE 1

Methanesulfonic acid: 50 g/l,
Sodium m-nitrobenzene sulfonate: 100 g/l,
Phenyl thiourea: 10 g/l.

EXAMPLE 2

Methanesulfonic acid: 100 g/l,
Sodium m-nitrobenzene sulfonate: 20 g/l,
Thiourea: 20 g/l.

EXAMPLE 3

Methanesulfonic acid: 30 g/l,
Sodium m-nitrobenzene sulfonate: 50 g/l,
1,3-dimethyl-2-thiourea: 3 g/l.

EXAMPLE 4

Propanesulfonic acid: 10 g/l,
Sodium 2,4-dinitrobenzene sulfonate: 70 g/l,
1,3-dimethyl-2-thiourea: 10 g/l.

EXAMPLE 5

Methanesulfonic acid: 60 g/l,
Sodium 2,4-dinitrobenzene sulfonate: 60 g/l,
Thiourea: 5 g/l.

EXAMPLE 6

Ethanesulfonic acid: 50 g/l,
Sodium 2,4-dinitrobenzene sulfonate: 50 g/l,
Thiourea: 8 g/l.

EXAMPLE 7

Methanesulfonic acid: 80 g/l,
Sodium 2,4-dinitrobenzene sulfonate: 100 g/l,
1,3 dimethyl-2-thiourea: 1 g/l.

EXAMPLE 8

Methanesulfonic acid: 120 g/l,
Ammonium m-nitrobenzene sulfonate: 30 g/l,
Thiourea: 2 g/l.

EXAMPLE 9

Methanesulfonic acid: 100 g/l,
Potassium m-nitrobenzene sulfonate: 60 g/l,
Thiourea: 2 g/l.

EXAMPLE 10

Methanesulfonic acid: 40 g/l,
Sodium m-nitrobenzene: 10 g/l,
Thiourea: 1 g/l.

EXAMPLE 11

Methanesulfonic acid: 50 g/l,
m-nitrobenzene sulfonic acid: 5 g/l,
Thiourea: 0,5 g/l.

EXAMPLE 12

Methanesulfonic acid: 70 g/l,
m-nitrobenzene sulfonic acid: 10 g/l,
1,3 dimethyl-2-thiourea: 2 g/l.

All the formulations indicated hereinabove are intended as having all their above mentioned components dissolved in an aqueous solution.

The various formulations cited hereinabove have been experimentally utilized for selectively stripping layers of tin and binary tin-lead alloys having various compositions, applied onto substrates of copper, of other metallic and non-metallic materials, by spraying them by means of machines of usual types having metallic parts made of titanium. The operations have been carried out at ambient temperature. In all the cases it has been found that the layers of tin or tin-lead alloy were stripped with negligible corrosion of the substrates, whilst no appreciable corrosion of the parts of the apparatuses made of titanium has taken place.

Therefore, the solution according to the invention allows one to carry out a process of selective stripping of layers of tin and tin-lead alloys from substrates, by means of non-modified usual apparatus, which process cannot be performed usefully with the baths of the prior art.

We claim:

1. A solution for selectively stripping a layer of tin or tin-lead alloy from a substrate, comprising in aqueous solution:

a first component being an organic acid of the group consisting of the alkylsulfonic acids having a number of carbon atoms from 1 to 4;

a second component being an organic oxidizer of the group consisting of the aromatic nitro-substituted and polynitro-substituted compounds having at least one group $—NO_2$ and a solubilizing group $—SO_3H$ or —COOH, and their alkaline salts; and a third component being a compound of the group consisting of thiourea and alkyl-substituted or aryl-substituted thioureas having low molecular weight.

2. A stripper solution as set forth in claim 1, wherein said organic acid is contained with a concentration ranging from 1 g/l to the saturation.

3. A stripper solution as set forth in claim 2, wherein said organic acid is contained with a concentration ranging from 30 g/l to 120 g/l.

4. A stripper solution as set forth in claim 3, wherein said organic oxidizer having a solubilizing group is contained with a concentration ranging from 0.5 g/l to the saturation.

5. A stripper solution as set forth in claim 4, wherein said organic oxidizer having a solubilizing group is contained with a concentration ranging from 20 g/l to 70 g/l.

6. A stripper solution as set forth in claim 5, wherein said third component is contained with a concentration ranging from 0.1 g/l to 50 g/l.

7. A stripper solution as set forth in claim 6, wherein said third component is contained with a concentration ranging from 1 g/l to 10 g/l.

8. A stripper solution as set forth in claim 1, wherein said organic acid is methanesulfonic acid.

9. A stripper solution as set forth in claim 1, which is adapted to be applied by means of a spraying operation at a temperature ranging from 0° C. to 70° C.

10. A stripper solution as set forth in claim 9, which is adapted to be applied by means of a spraying operation at a temperature ranging from 15° C. to 25° C.

* * * * *